United States Patent [19]

Dassler

[11] 4,134,220

[45] Jan. 16, 1979

[54] SPORTS SHOES

[76] Inventor: Adolf Dassler, Herzogenaurach, Fed. Rep. of Germany

[21] Appl. No.: 819,603

[22] Filed: Jul. 27, 1977

[30] Foreign Application Priority Data

Aug. 6, 1976 [DE] Fed. Rep. of Germany ..... 2635474

[51] Int. Cl.[2] ..... A43B 5/00; A43B 13/12

[52] U.S. Cl. ..... 36/30 R; 36/114

[58] Field of Search ..... 36/114, 130, 30 R, 31, 36/83, 113, 103, 12, 14, 77 R, 77 M, 78

[56] References Cited

U.S. PATENT DOCUMENTS 3,177,598 4/1965 Ferreira ..... 36/30 R 3,226,851 1/1966 Marcy ..... 36/30 R

FOREIGN PATENT DOCUMENTS 2513990 7/1976 Fed. Rep. of Germany ..... 36/114

502429 3/1939 United Kingdom ..... 36/31

1152713 5/1969 United Kingdom ..... 36/14

*Primary Examiner*—Patrick D. Lawson

[57] ABSTRACT

A sports shoe, in particular a tennis shoe, has a sole made of rubber or flexible plastics material and a protective layer of chrome-tanned leather is applied to the running surface of the sole at least in the area which is subject to wear, namely in the area of the point of the shoe, for wear resistance purposes.

7 Claims, 1 Drawing Figure

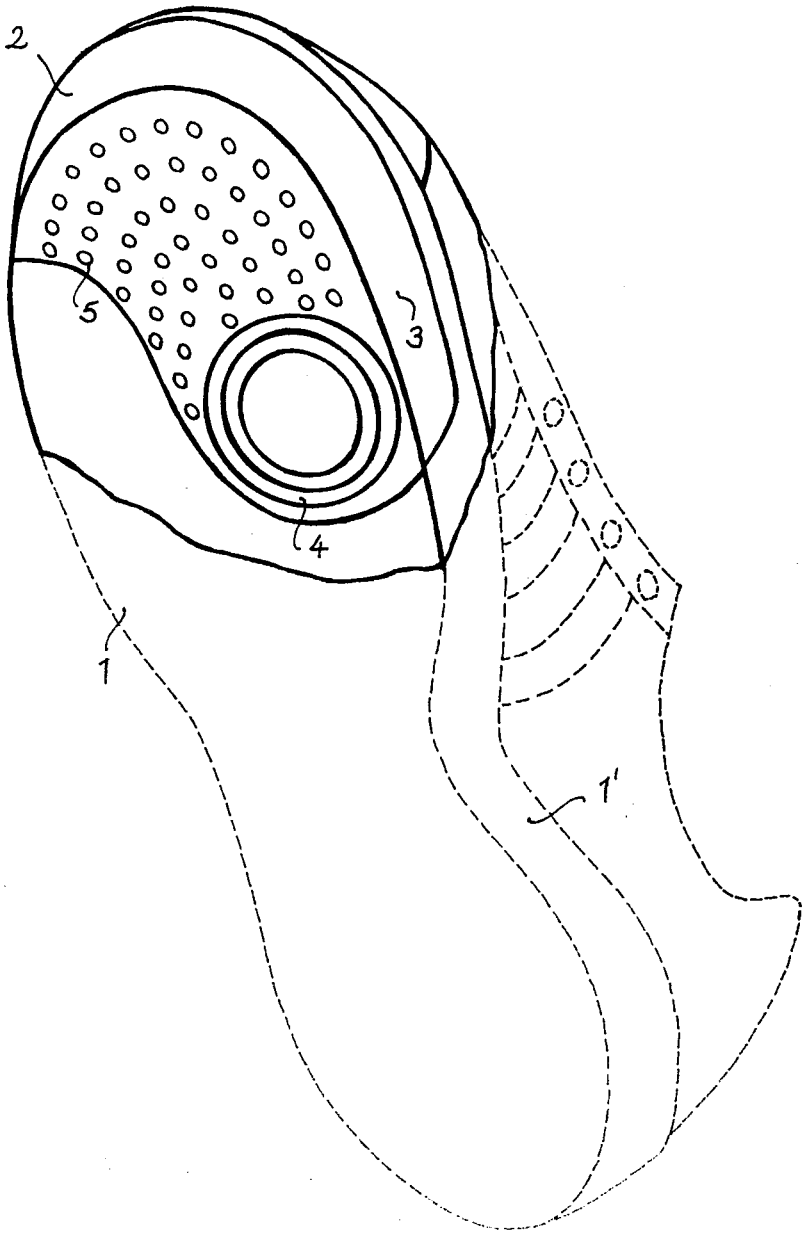
2
5
3
4
1
1'

SPORTS SHOES

The present invention relates to sports shoes.

It has long been known that the change from grass courts and sand courts to plastic courts and hard courts has brought particular problems with regard to the life of the sports shoes worn by the players as well as regarding health-damaging effects. This is because the plastic courts, with their tartan surfaces, carpet surfaces and asphalt surfaces, exert an abnormally high wear on the conventional sports shoes, which very frequently limits the life of the sports shoes to four weeks and even less. This applies especially to rough concrete courts and similar courts, which very rapidly abrade the soft soling materials which are required because of the hardness of such courts. Many proposals have been made for combating the wear problem and at the same time avoiding the health-damaging effects of these plastic surfaces and hard surfaces of these courts. Regarding the health-damaging effects, a known sole design of the type described in German Offenlegungsschrift No. 2,312,198 has proved successful, according to which the sole consists of a textile fabric treated with rubber or a similar material, in which the rubber penetrates the textile fabric so that the interstices in the fabric are filled with the rubber, whilst a part of the textile fabric is exposed on the running face. This known sole design permits, especially when using carpet surfaces in indoor tennis courts, a sliding of a few centimeters, so that the known health-damaging effects on the body structure of the players can be avoided. At the same time, this known sole gives a resistance to wear on carpet surfaces which is far superior to the soles used hitherto. On tennis surfaces of a different type, especially on hard courts, the wear resistance of this design of sole is, however, not sufficiently great to enable the life of tennis shoes used on grass courts and sand courts to be achieved.

Proposals have therefore also already been made to provide inserts of highly wear-resistant plastic of various types in the more highly stressed areas of the sole and of the shoe point, especially at the front rim of the sole and at the inner ball, in order to conform to the requirements for softness of the sole, high wear resistance and limited sliding capacity with, at the same time, resistance to sliding when the foot is placed down. However, hitherto only partial successes were achievable by these means, since all these requirements simultaneously could only be fulfilled on particular plastic courts or hard courts, whilst universal applicability, with the same success, to the broad range of materials for plastic courts and hard courts has hitherto not been achievable.

According to the present invention there is provided a sports shoe comprising an upper, a sole of flexible plastics material or rubber secured to said upper and a protective layer of chrome-leather extending over the running surface of the sole at least in the forward part thereof.

In the remainder of the Specification the term "plastics material" will be used to describe both rubber and more conventional plastics.

It has been found, surprisingly, that specifically chrome-tanned leather, especially suede split leather, possesses a resistance to the stresses caused by plastic courts and hard courts which is substantially superior to the resistance of the materials hitherto used for the purpose. Above all, chrome-tanned leather which is provided in the form of an insert, in the area of the shoe point, on the soft material proves to be resistant to very different types of plastic courts, and experiments have shown that compared to the known proposals described above and based on plastic inserts, the life achieved can at least be doubled. It is assumed here that the wear action on the plastic materials used hitherto is based on different wear mechanisms, with the heat generated as the sole slides and drags on the ground playing a substantial role. This generation of heat evidently leads locally to such high temperature levels, even if wear-resistant plastic materials are used, that the resistance of the plastic in such areas decreases greatly. However, chrome-tanned leather proves, in this respect, to be substantially less heat-sensitive and furthermore exhibits great toughness towards purely mechanical stresses. This is assisted by the leather insert resting on the flexible soft base material for the plastics material sole of the sports shoe, so that the stresses occurring are distributed over a larger area as a result of the substrate being able to "give". What is essential for the success achieved is thus the combination of the chrome leather layer with the soft plastics material of the sports shoe sole, which consists, for example, of polyurethane foam.

The layer of chrome-tanned leather, especially suede split leather, can either be provided only at the front rim of the sole, in order, in this way, to reduce the wear resulting from the dragging which is characteristic in tennis, and as a result of the shoe being set down on its inner edge, or alternatively, according to an advantageous further development, the layer of chrome leather can extend into the outsole, preferably as far as the area of the inner ball. In that case, the protective layer may be perforated, and the plastics material of the outsole may extend through and be flush with the lower surface of the protective layer in such a way that it makes contact with the ground when the foot is set down. This ensures that the ability of the leather to slide is brought into balance, to the desired extent, with the resistance to sliding which is provided by the plastics material of the outsole. The orifices of the perforation in the leather layer suitably have a diameter of between 2 and 15 mm.

The thickness of the chrome leather layer is preferably at least 2.5 mm and is hence greater than that of the materials of the uppers of sports shoes, for which chrome-tanned leather has hitherto been employed. On the other hand, chrome-tanned leather has hardly found use hitherto as a soling material; for this purpose vegetable-tanned leathers have in the main been used. These, however, prove not to be usable for the purpose aimed at here.

It is possible to bond the chrome leather layer to the plastics material of the outsole by gluing. However, it is more advantageous to bond this layer to the soling material directly, in the mould, when the plastics material sole is manufactured by moulding, so that the layer is embedded in the soling material. This proves advantageous above all when the layer has the perforations mentioned, since the plastics material will flow through the orifices during the moulding.

In order that the invention will be more fully understood, the following description is given, merely by way of example, reference being made to the accompanying drawing, in which the only FIGURE is a front perspective view from below, of one embodiment of shoe according to the invention, only the front sole area, including the toe cap, being shown in solid lines.

The tennis shoe has an outsole 1, constructed as a shell sole, which overlaps the shoe upper by means of a rim 1' which is drawn up at the side, and is bonded to the upper. The outsole 1 consists of a flexible soft plastic material, for example polyurethane foam, and is profiled in a manner which is not shown. The outsole 1 can be manufactured separately and be bonded subsequently to the ready-lasted shoe upper; however, it is more appropriate to mould it directly onto the shoe upper.

In the area of the shoe point, at the forward part of the sole a protective layer 2 of a chrome-tanned suede split leather is embedded in the outsole 1; this layer — as may be seen from the drawing — covers the underside of the outsole 1 as far as the inner ball area and furthermore is drawn up, in the form of a strip 3, over the edge of the sole. At the inner ball itself, a ring profile 4 which is in itself known, and which is formed by the plastics material of the outsole 1, is provided. At this point, the outsole 1 passes through the leather layer 2.

In the part of the leather layer 2 which is on the running face of the sole 1, the layer is perforated to provide a plurality of orifices 5 which have a diameter between 2 and 15 mm. In the area of these orifices, the plastics material of the outsole is exposed and extends outwards to the point where it is flush with the running surface of the leather layer 2. Hence, at these points, the plastic material can come into contact with the ground when the foot is set down. By varying the size and number of the orifices 5 it is possible to decide the extent to which the outsole 1 slides as desired, when the player stops running, in order to reduce peak stresses on the joints and ligaments of the tennis player. It is also conceivable, instead of having annular grooves in the area of the ring profile 4, also to have a ring-shaped construction of the chrome leather layer 2 in this area.

The thickness of the layer 2 is preferably 2.5 mm but can also be chosen thicker, since an excessively stiffening effect, which would interfere with the rolling movement of the foot, need not be feared. Furthermore, the layer 2 can be drawn up over the sole rim 1' as far as the toe cap in order to provide wear resistance there also; it can also be perforated in the area of the sole rim 1' and, if desired, at the toe cap, and the orifices 5 of this perforation may be identical or different, in distribution and size, from those of the running surface. Also the ring profile 4 may be partially or totally covered or formed by the leather layer 2.

I claim:

1. A sports shoe comprising, in combination:-

(a) an upper;

(b) a sole of soft flexible plastics material or rubber secured to said upper and having a forward part, a running surface and an edge; and (c) a protective layer of chrome-leather extending around at least the forward part of the edge of the sole and covering the running surface of the forward part of the sole as far as the inner ball of the foot of a wearer of the shoe.

2. A sports shoe as claimed in claim 1 and further comprising means defining perforations in the protective layer, wherein the material of the sole extends through said perforations to be flush with the lower surface of the protective layer.

3. A sports shoe as claimed in claim 2, wherein said perforations have a diameter of between 2 and 15 mm.

4. A sports shoe comprising in combination;

(a) an upper;

(b) a sole of soft flexible plastics material or rubber secured to said upper and having a running surface and an upstanding rim bonded to said upper; and (c) a protective layer of chrome-tanned leather extending around and covering said rim at least partially at the tip of said sports shoe.

5. A sports shoe as claimed in claim 1, wherein said protective layer is formed of suede split leather.

6. A sports shoe as claimed in claim 1, wherein said protective layer extends along the edge of the sole to the upper, at least at the forward part of the sole.

7. A sports shoe as claimed in claim 1, wherein the layer covers the running surface of the forward part of the sole as far as the inner ball of the foot of the wearer of the shoe.

* * * * *

UNITED STATES PATENT AND TRADEMARK OFFICE

CERTIFICATE OF CORRECTION

PATENT NO. : 4,134,220

DATED : January 16, 1979

INVENTOR(S) : ADOLF DASSLER

It is certified that error appears in the above-identified patent and that said Letters Patent are hereby corrected as shown below:

Claims 5, 6 and 7, line 1 of each claim,

Change "claim 1" to --claim 4--.

Signed and Sealed this

*Twenty-second* Day of *April 1986*

[SEAL]

*Attest:*

DONALD J. QUIGG

*Attesting Officer*

*Commissioner of Patents and Trademarks*